US005542641A

United States Patent [19]

Donovan

[11] Patent Number: 5,542,641

[45] Date of Patent: Aug. 6, 1996

[54] WALL HANGER, MOUNTING KIT, AND METHOD

[76] Inventor: Charles A. Donovan, 4509 Clarksdale Ct., Orlando, Fla. 32812

[21] Appl. No.: 226,968

[22] Filed: Apr. 13, 1994

[51] Int. Cl.[6] ..... A47G 1/16

[52] U.S. Cl. ..... 248/493; 248/489; 248/497; 248/262

[58] Field of Search ..... 248/200, 251, 248/254, 262, 264, 304, 488, 489, 490, 493, 497, 475.1

[56] References Cited

U.S. PATENT DOCUMENTS

| | | | |
|---|---|---|---|
| D. 33,497 | 11/1900 | Williams | 248/489 X |
| 1,272,696 | 7/1918 | Mock | 411/460 |
| 1,292,956 | 1/1919 | McConnal | 248/489 |
| 3,995,821 | 12/1976 | Einhorn | 248/216.1 |
| 4,094,490 | 6/1978 | Einhorn | 248/489 |
| 4,739,961 | 4/1988 | Thomas | 248/490 |
| 5,018,697 | 5/1991 | Treanor et al. | 248/547 |
| 5,069,412 | 12/1991 | Jacob | 248/493 |

*Primary Examiner*—Alvin C. Chin-Shue
*Assistant Examiner*—Derek J. Berger
*Attorney, Agent, or Firm*—Allen, Dyer, Doppelt, Franjola & Milbrath, P.A.

[57] ABSTRACT

The wall hanger of the present invention is designed to minimize the damage done to a wall when hung thereon. The wall hanger has a plurality of narrow bores angling generally downward through which straight pins may be inserted to anchor the wall hanger. A variety of embodiments are provided, including hangers for pictures, plates, and curtains, and a combination frame-hanger unit. In addition, a mounting tool is disclosed that bores a hole in the wall through the bores in the hanger and then is used to push a straight pin through the bore and into the hole in the wall. A removal tool is also provided for removing pins from a mounted wall hanger. A kit is provided that consists of a wall hanger, a mounting tool, and a removal tool. In addition, methods are provided for mounting a wall hanger to a wall and for removing the wall hanger from the wall.

7 Claims, 8 Drawing Sheets

WALL HANGER, MOUNTING KIT, AND METHOD

BACKGROUND OF THE INVENTION

1. Field of the Invention

The present invention relates to devices for mounting objects to a wall or a similar vertical surface, and, more particularly, to devices for affixing objects to a semipermeable surface such as drywall.

2. Description of Related Art

Various implements have been devised to hang objects from walls. Most such hangers have comprised screws or nails, which typically must have a sufficiently large diameter to support the weight of the object. Thus most of these devices, when used on a semipermeable material such as drywall, will leave unsightly holes when removed and may even tear the drywall covering. In addition, the tools used to drive the anchoring means of the devices, such as hammers, can also cause damage to the wall.

Mock (U.S. Pat. No. 1,272,696) describes a picture hanger that comprises a double-pointed pin inserted into a wall at an angle to the horizontal. McConnal (U.S. Pat. No. 1,292,956) discloses a hanger that comprises a wall plate having a needle or pin projecting at an angle that can be pressed into a wall without marring the surface. An object hanger for drywall is described by Treanor et al. (U.S. Pat. No. 5,018,697) that utilizes a straight pin pushed through an aperture in the hanger body.

SUMMARY AND OBJECTS OF THE INVENTION

It is accordingly an object of the present invention to provide a hanger that minimizes the damage done to a wall.

It is a further object to provide a hanger that utilizes affixing members of sufficiently small diameter to avoid making large holes in the wall.

It is a further object to provide a hanger for disk-shaped items such as plates having means for adjusting the spacing between the disk and the hanger for protecting the surface of the disk facing the wall.

It is another object to provide a tool for use in mounting the wall hanger.

It is a further object to provide a tool for use in removing the wall hanger.

It is an additional object to provide a kit for affixing a hanger to a wall including the hanger and the mounting tool.

It is a further object to provide a kit for removing the wall hanger from a wall including the hanger, the mounting tool, and the removal tool.

It is yet another object to provide a method for affixing objects to a vertical surface such as a wall that minimizes the damage done to the wall.

It is an additional object to provide a method for removing the hanger that also minimizes the damage done to the wall.

The above objects are accomplished by the various aspects and embodiments of the present invention, among which is included a wall hanger comprising a base and means for supporting the object to be hung. The base has a generally planar first side for interfacing with the wall, a second side opposed to the first side, a top edge, and a bottom edge. The base further has a plurality of narrow bores extending from the second side to the first side and angling away from the top edge. Each bore is sufficiently narrow and long to permit a narrow affixing means such as a straight pin to pass through the bore and penetrate the wall when the base's first side is placed against the wall. In addition, the bores are situated sufficiently close to the top edge that the portion of the base between the bores and the bottom edge is sufficient to provide resistance to a moment caused by suspending an object from the support means, which are affixed to and protrude from the second side of the base.

The use of straight pins is advantageous because a minimum amount of damage is done to a wall with their insertion and removal. It has been found that all types of walls, including but not limited to drywall, plaster, wood, and plaster, and all types of wall coverings, including but not limited to wallpaper and vinyl, are amenable to having the wall hanger of the present invention mounted thereto.

A picture hanger is one embodiment of the above invention. In this embodiment the bores are situated along the top edge of the base, and the support means comprises a unitary protrusion having means for restraining the hanging means of the object to be hung, which may, for instance, comprise a picture wire, the edge of a frame, or a frame eyelet. Such a unitary protrusion may comprise an element such as a screw, where the screw head serves as the restraining means.

A plate hanger is another embodiment of the present invention. In this embodiment the support means comprises a support member positioned generally along the bottom edge of the base. The support member has a first end affixed to the second side of the base and a second end having means for cradling the plate. These cradling means in one embodiment comprise a pair of support arms positioned in spaced relation to each other.

An additional feature of the plate hanger of the present invention is that of spacing means affixed to the second side of the base between the bottom edge and the top edge for biasing the object away from the base. This serves to protect the back side of the plate from potential damage such as scratching by the base. One embodiment of this device features an adjustable-thickness spacer for biasing the object at variable distances from the base. The spacing means may also include a protective surface against which the plate may rest, thus providing further protection.

Other embodiments of the invention include hanging devices for curtain rods and shelves and one that is an integral part of a picture or document frame.

A mounting tool is also provided as an additional aspect of the present invention. This tool, which is capable of making holes in a semipermeable wall surface preparatory to inserting the straight pin through the base of the hanger, comprises a pointed borer at one end and a handle at the other end. The borer is dimensioned for making holes in a wall after having passed through a bore of the base of the wall hanger. The borer has a length dimensioned to make a hole in a wall sufficiently deep to house a straight pin. The bore's handle has a first end, at which it is affixed to the borer, and a second end, which has an indentation therein dimensioned to surround the head of a pin and to push the pin through a bore in the base and into a wall.

A removal tool is also provided that has a pin remover affixed at a first end. The pin remover has a channel therein dimensioned to surround a shaft of a pin but smaller than a head of a pin so that the pin may be pried away from the wall. The removal tool further has a bore at the second end dimensioned to receive the mounting tool for storage thereof when not in use.

A wall hanger kit is further provided that comprises a wall hanger and a mounting tool as described above. An additional wall hanger kit also comprises a removal tool for extracting the pins from the wall.

The method for mounting an object on a wall using the wall hanger of the present invention comprises the steps of providing a wall hanger as described above, placing the wall hanger with the first side against a wall and the top edge facing generally upwards, pushing a boring tool through each bore to form a hole in the wall aligned with each bore, the hole being sufficiently long to enable a straight pin to pass through the bore and into the wall, pushing a straight pin into each bore, and mounting an object upon the support means.

An additional method is provided for removing the wall hanger of the present invention that comprises the steps of providing a wall hanger as described above, mounted with the use of straight pin means penetrating a bore and the wall. The wall hanger is then removed from the wall by engaging the head of the pin with a removal tool as described above, pulling the pin out of the wall using the removal tool, and removing the hanger from the wall.

The features that characterize the invention, both as to organization and method of operation, together with further objects and advantages thereof, will be better understood from the following description used in conjuction with the accompanying drawing. It is to be expressly understood that the drawing is for the purpose of illustration and description and are not intended as a definition of the limits of the invention. These and other objects attained, and advantages offered, by the present invention will become more fully apparent as the description that now follows is read in conjuction with the accompanying drawing.

BRIEF DESCRIPTION OF THE DRAWINGS

FIG. 1(*b*) is a front view of a further embodiment of the picture hanger.

FIG. 2(*b*) is a side view of an alternate embodiment of the picture hanger.

FIG. 7(*b*) illustrates a removal tool for use in dislodging the wall hanger from a wall.

DETAILED DESCRIPTION OF THE PREFERRED EMBODIMENTS

A description of the preferred embodiments of the present invention will now be presented with reference to FIGS. 1–9.

Figure 1A:
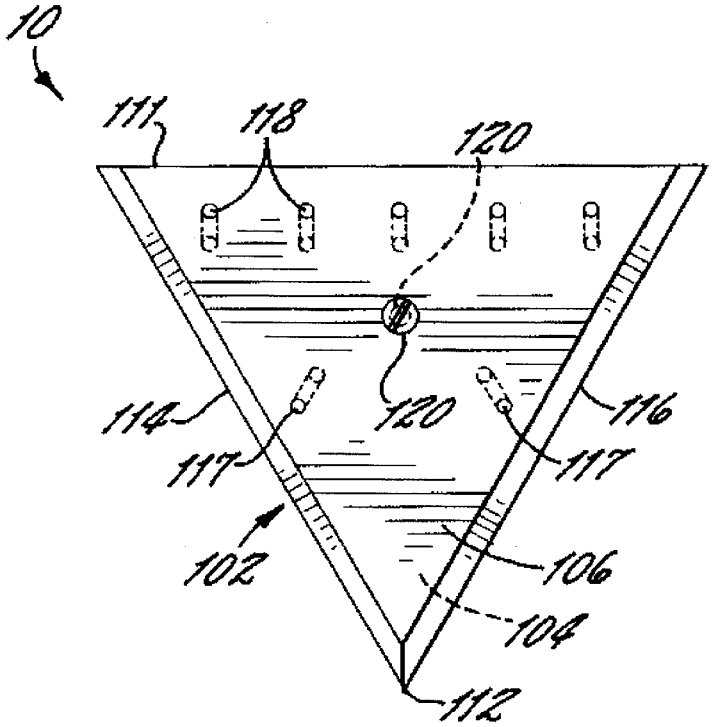
FIG. 1(*a*) is a front view of the picture hanger of the present invention.
Figure 1B:
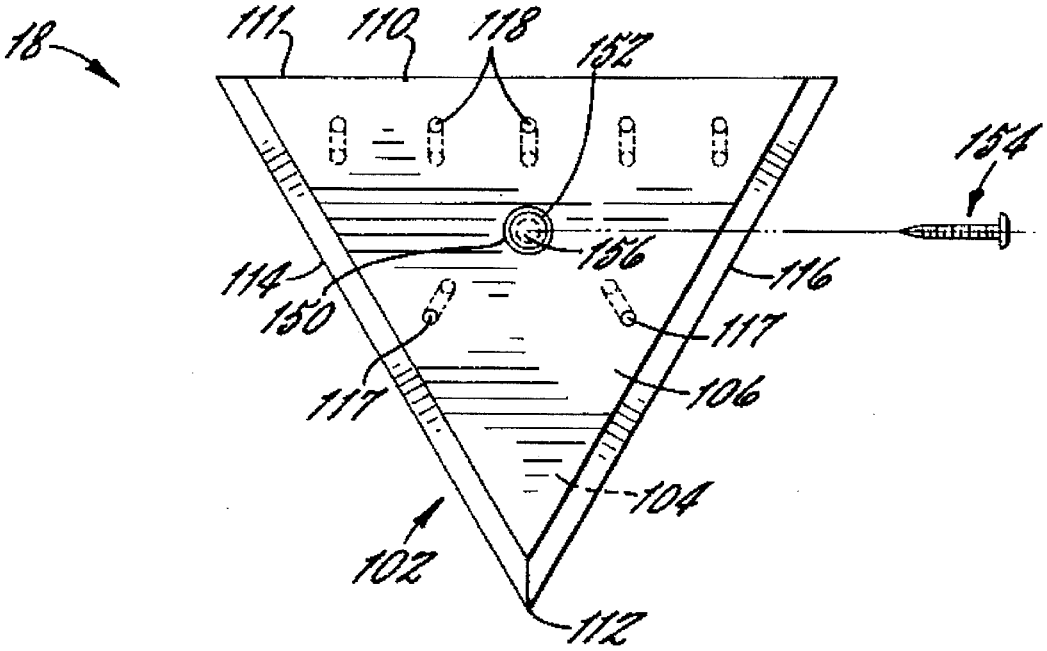

In FIGS. 1(*a*) and 2(*a,b*) is shown a preferred embodiment of a wall hanger for minimizing damage to a wall. This embodiment is designed for use with objects such as pictures, and will be referred to generally by the reference numeral 10.

The picture hanger 10 of this embodiment comprises a triangular clear plastic base 102 that has a generally planar first side 104 for interfacing with a wall 60 and a generally planar second side 106 opposed to first side 104. Since the base 102 is clear, determining the location for hanging is facilitated. Base 102 further has a top edge 110 along a first edge 111 of the triangular base and a bottom 112 defined by the point formed by the junction of the beveled second 114 and third 116 edges of triangular base 102. In the preferred embodiment base 102 is formed of a clear plastic such as acrylic.

Along the top edge 110 are positioned a plurality of narrow bores 118. Bores 118, in the preferred embodiment numbering five, extend in a direction away from top edge 110 from second side 106 to first side 104. Additional bores 117, in the preferred embodiment numbering two, are located beneath bores 118, one adjacent each edge 114 and 116, extending in a direction generally normal to the respective edge 114 and 116. Bores 118 and 117 are sufficiently narrow and sufficiently long to permit a straight pin 70 to pass therethrough and penetrate wall 60 when first side 104 is placed against wall 60. Support bore 128 is positioned in base 102 beneath bores 118. Support bore 128 extends from second side 106 but not through to first side 104.

The straight pins 70 recommended for use with the present invention comprise #12 pleating pins for use in drywall and plaster walls and #8 pleating pins for use in wood and paneling. It has been found that the 5-pin embodiment can support up to 50 pounds.

The support means of the picture hanger comprises a screw 120 having a first end 122 molded into support bore 128 in base 102 and a second end 124 having a screw head 126 for restraining a picture wire or the frame of a picture when the wire or frame has been hung upon screw 120.

Figure 2A:
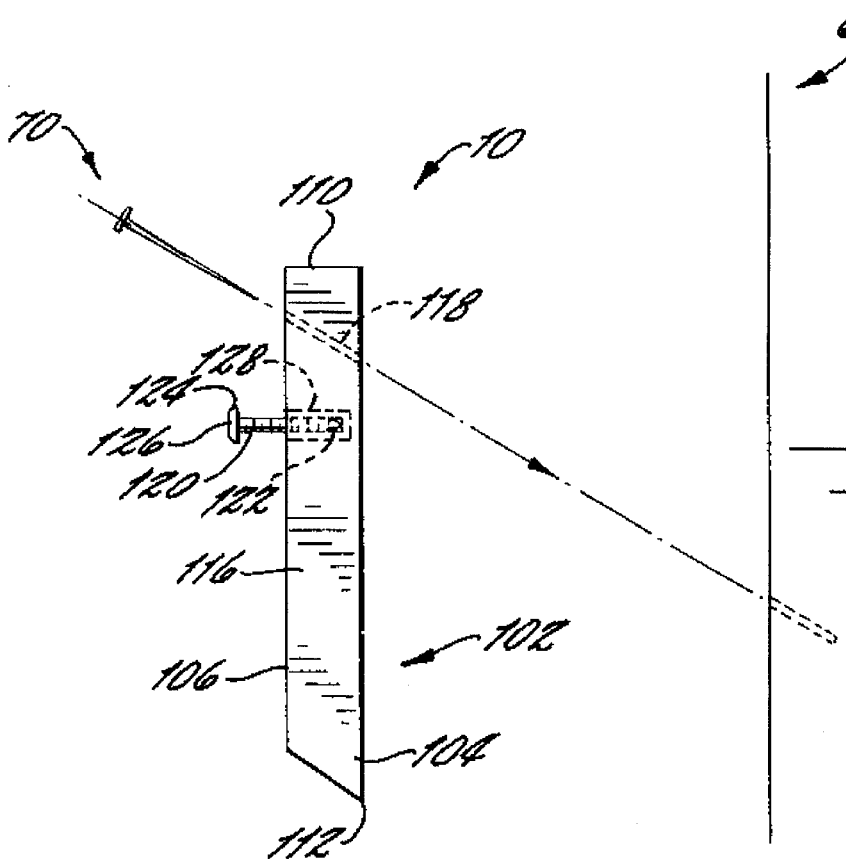
FIG. 2(*a*) is a side view of the picture hanger of FIG. 1(*a*).
Figure 2B:
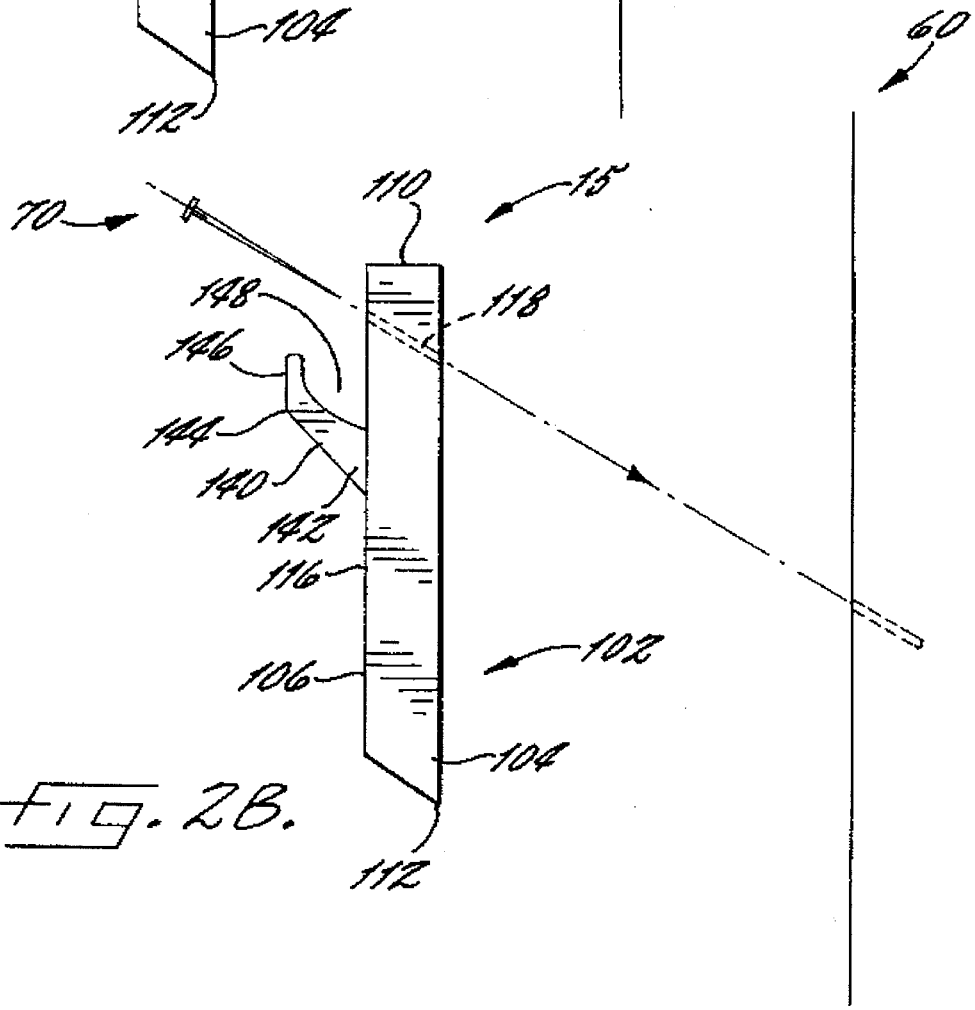

An alternate embodiment of the triangular picture hanger is shown in FIG. 2(*b*), indicated by the reference numeral 15. The only difference between this embodiment and that discussed above is that the support means comprises a molded hook 140 having a first end 142 integrally connected to second side 106 and a second end 144 having an upwardly extending portion 146 defining a valley 148 onto which a picture wire or the like may be hung and restrained by the upwardly extending portion 146.

A further embodiment of the triangular picture hanger is shown in FIG. 1(*b*), indicated by the reference numeral 18. The only difference between this embodiment and that discussed with reference to FIG. 1(*a*) is that the support means comprises an insert bore 150 in second side 106 and a snapfit metal insert 152 having a threaded bore 156 into which a screw 154 may be threaded to serve as the support means. The advantage of insert 152 is that a plurality of inserts could be provided in order to enable the user to choose from a range of screw sizes and lengths and thus tailor the wall hanger 18 to a particular usage.

Figure 3:
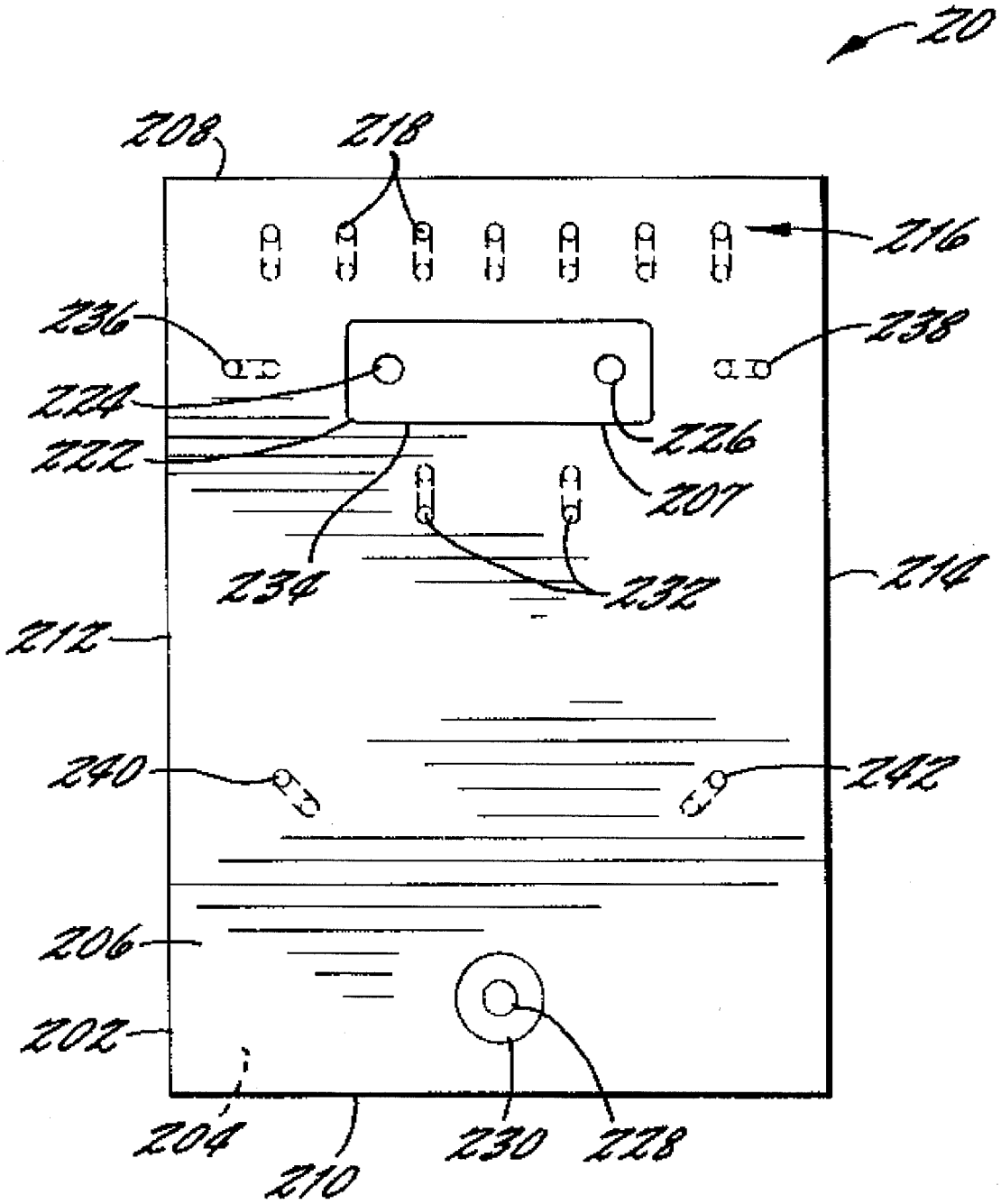
FIG. 3 is a front view of a curtain rod hanger.

Another embodiment of the present invention, as shown in FIG. 3, is a curtain rod hanger 20. This embodiment comprises at least a pair of rectangular clear plastic bases 202 (only one is shown), in use the bases 202 affixed to a wall 60 in spaced relation to each other to support curtain rods. Each base has a generally planar first side 204 for interfacing with wall 60, a generally planar second side 206 opposed to first side 204, a top 208 and a bottom 210 edge, a left 212 and a right 214 side edge.

As with the previous embodiment of a wall hanger, curtain rod hanger 20 has a first set 216 of narrow bores 218 positioned along the top edge 208 extending in a direction away from the top edge 208 from the second side 206 to the first side 204. Each bore 218 is sufficiently narrow and sufficiently long to permit a straight pin 70 to pass therethrough and penetrate a wall 60 when the first side 204 is placed against the wall 60. In the preferred embodiment, the first set 216 of narrow bores 218 comprises seven narrow bores 218; however, this number may be tailored to suit the support needs of each specific situation.

A support bore in second side 206, which may be threaded, not extending through to first side 204, is positioned between the first set 216 of narrow bores 218 and the bottom edge 210 for receiving affixing means of a curtain rod bracket, which typically comprises a screw threaded through or molded into the bracket and into the support bore. In the preferred embodiment generally rectangular recess 222 in second side 206, having rounded corners 207, is positioned adjacent first set 216 of narrow bores 218. Recess 222 houses a pair of support bores 224 and 226 in a line generally parallel to the first set of narrow bores 218. A third support bore 228 is positioned in circular recess 230 adjacent bottom edge 210 for additional support.

A second set 232 of narrow bores 218 is positioned between recess 222 and recess 230, generally adjacent the bottom edge 234 of recess 222. These bores 218, in the preferred embodiment numbering two, extend in a direction toward top edge 208 from second side 206 to first side 204.

A third 236 and a fourth 238 set of narrow bores 218 are positioned between recess 222 and the left 212 and right side edges, respectively. In the embodiment shown, these sets 236 and 238 comprise one bore 218 extending in a direction toward the recess 222 from the second side 206 to the first side 204.

In the embodiment shown in FIG. 3, two additional narrow bores 240 and 242 are positioned between recess 230 and second set 232, generally adjacent left 212 and right 214 side edges, respectively. Bores 240 and 242 each angle from second side 206 to first side 204 at an angle with left 212 and right 214 side edges, respectively, toward recess 230.

It may be appreciated by one skilled in the art that various combinations of support and narrow bores are possible and may be tailored to suit the specific needs of the object to be hung therefrom.

Figure 4:
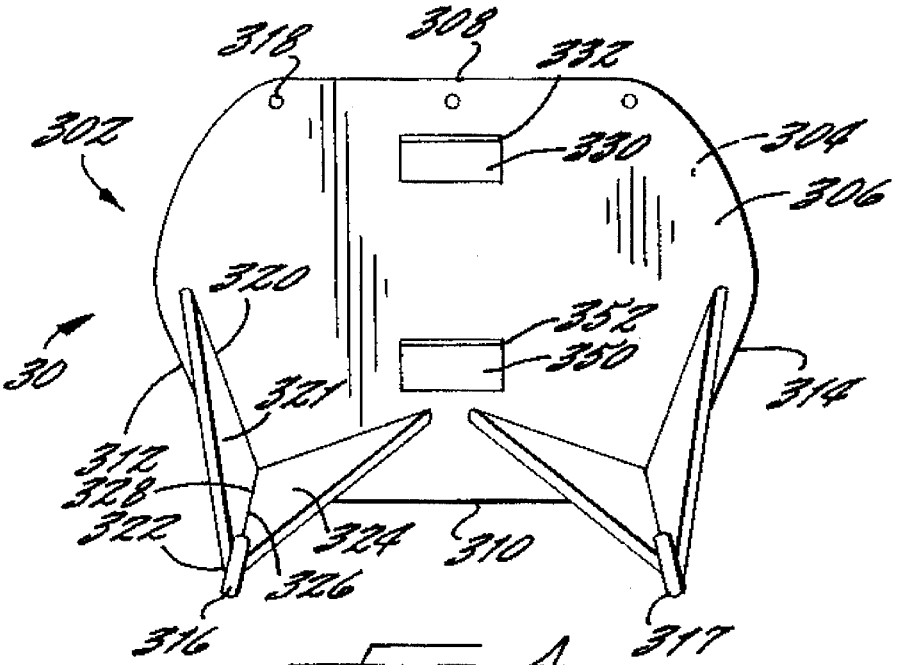
FIG. 4 is a front view of a plate hanger having adjustable-thickness spacers.
Figure 5:
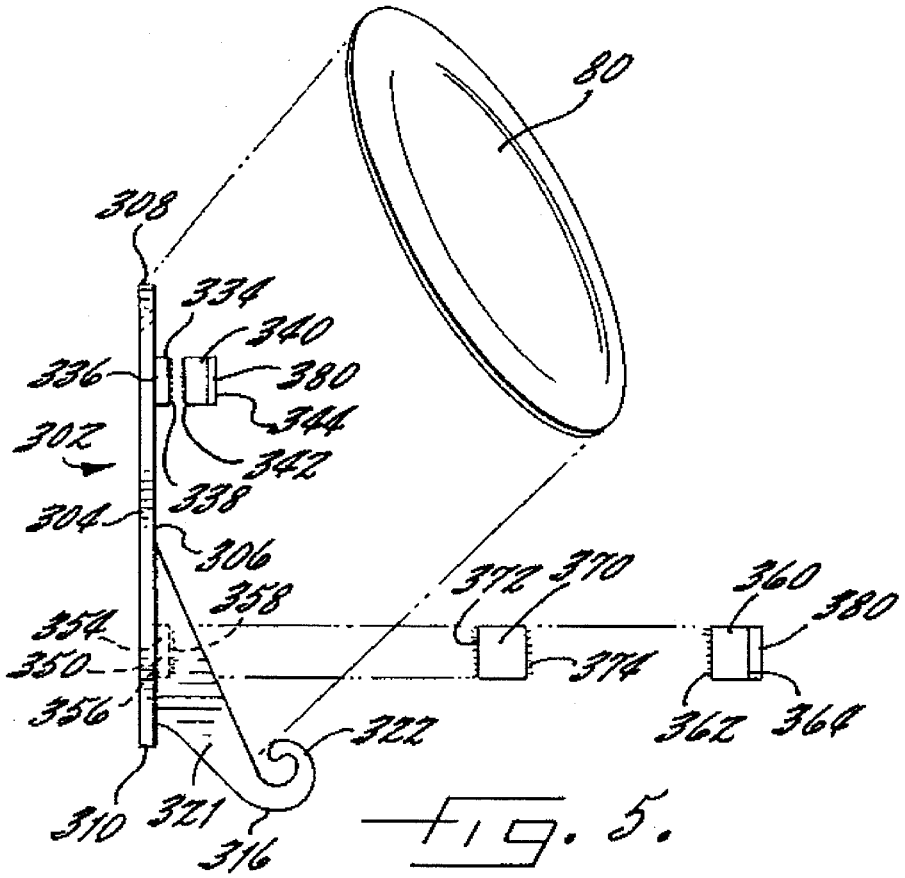
FIG. 5 is a side view of the plate hanger of FIG. 4.

In FIGS. 4 and 5 are shown two views of an embodiment that comprises a plate or plaque hanger 30. Plate hanger 30 comprises a clear plastic base 302, which has a generally planar first side 304 for interfacing with wall 60, a generally planar second side 306 opposed to first side 304, a top edge 308, a bottom edge 310, and left 312 and right 314 side edges. In the preferred embodiment, top edge 308 comprises a generally straight edge meeting side edges 314 at smooth, curved corners. Side edges 312, 314 are generally straight, each forming an angle of approximately 110 degrees with bottom edge 310. Base 302 may be sized to be obscurable by the plate to be hung.

As with the previous embodiments, a plurality of narrow bores 318 are positioned along top edge 308, extending in a direction away from top edge 308 from second side 306 to first side 304. In the preferred embodiment, three bores 318 are placed along top edge 308, one at the center point of top edge 308 and two spaced equidistant therefrom.

In plate hanger 30, the support member comprises a left 316 and a right 317 support arm positioned in spaced relation generally along the bottom edge 310 of base 302, each support arm 316 and 317 having a first end 320 affixed to the second side 306 of base 302 and a second end 322 having means for cradling a plate 80.

Left support arm 316 will be discussed in detail; right support arm 317 is a mirror image thereof. In the embodiment shown, left support arm 316 comprises a unitary piece of clear plastic formed into a shape for cradling a plate 80. First end 320 comprises a V-shaped member glued to base 302. Side wing 321 of the V-shaped member is positioned adjacent left side edge 312. Wing junction 326 is positioned adjacent the junction 328 of left side edge 312 and bottom edge 310. Bottom wing 324 of the V-shaped member forms an angle of approximately 20 degrees with bottom edge 310. Side 321 and bottom 324 wings of first end 320 taper inward toward second end 322, which is a narrowed portion rolled into an upwardly curling brace against which the bottom of plate 80 may rest.

An additional feature of plate hanger 30 comprises elements for protecting plate 80 and for biasing plate 80 away from base 302. A first spacing means 330 for biasing plate 80 a first distance 332 away from base 302 is affixed to second side 306 of base 302 beneath bores 318. In the preferred embodiment first spacing means 330 comprises a first 334 and a second 340 spacer. First spacer 334 has a first side 336 and a second side 338, the first side 336 being glued to second side 306 of base 302. Second side 338 comprises a first half of a pair of materials comprising a hook-and-loop-type fastener that adhere when pressed together, known as Velcro™. Second spacer 340 has a first 342 and a second 344 side, the first side 342 comprising a second half of a pair of materials that adhere when pressed together.

A second spacing means 350 is affixed to second side 306 of base 302 between the first spacing means 330 and the support arms 316, 317 for biasing plate 80 a second distance 352 away from base 302, which is greater than the first distance 332. The second spacing means 350 comprises a third 354, a fourth 360, and a fifth 370 spacer.

Third spacer 354 has a first 356 and a second 358 side, the first side 356 affixed to second side 306 of base 302. The second side 358 comprises a first half of a pair of materials that adhere when pressed together, known as Velcro™.

Fourth spacer 360 has a first 362 and a second 364 side, the first side 362 comprising a second half of a pair of materials comprising a hook-and-loop-type fastner, (Velcro™) that adhere when pressed together.

Fifth spacer 370 has a first side 372 comprising a second half of a pair of materials that adhere when pressed together comprising a hook-and-loop-type fastner, (Velcro™) and a second side 374 comprising a first half of a pair of materials comprising a hook-and-loop-type fastner, (Velcro™) that adhere when pressed together.

Assembly of the second spacing means 350 consists in affixing the first side 372 of fifth spacer 370 to the second side 358 of third spacer 354 and the second side 374 of fifth spacer 370 is affixed to the first side 362 of fourth spacer 360.

It may be appreciated by one skilled in the art that variable biasing distances may be achieved by inserting additional spacers in the first 330 and second 350 spacing means, or by altering the widths of the first 330 and second 350 spacing means.

A further feature of plate hanger 30 is a means for protecting the back surface of plate 80 when being supported by plate hanger 30. In the preferred embodiment this protection means comprises a protective material 380 such as a layer of foam applied to the second side 344 of the second spacer 340 and the second side 364 of the fourth spacer 360. It can thus be seen that plate 80 is cushioned by the protective material 380 and will be protected from scratching.

Figure 6:
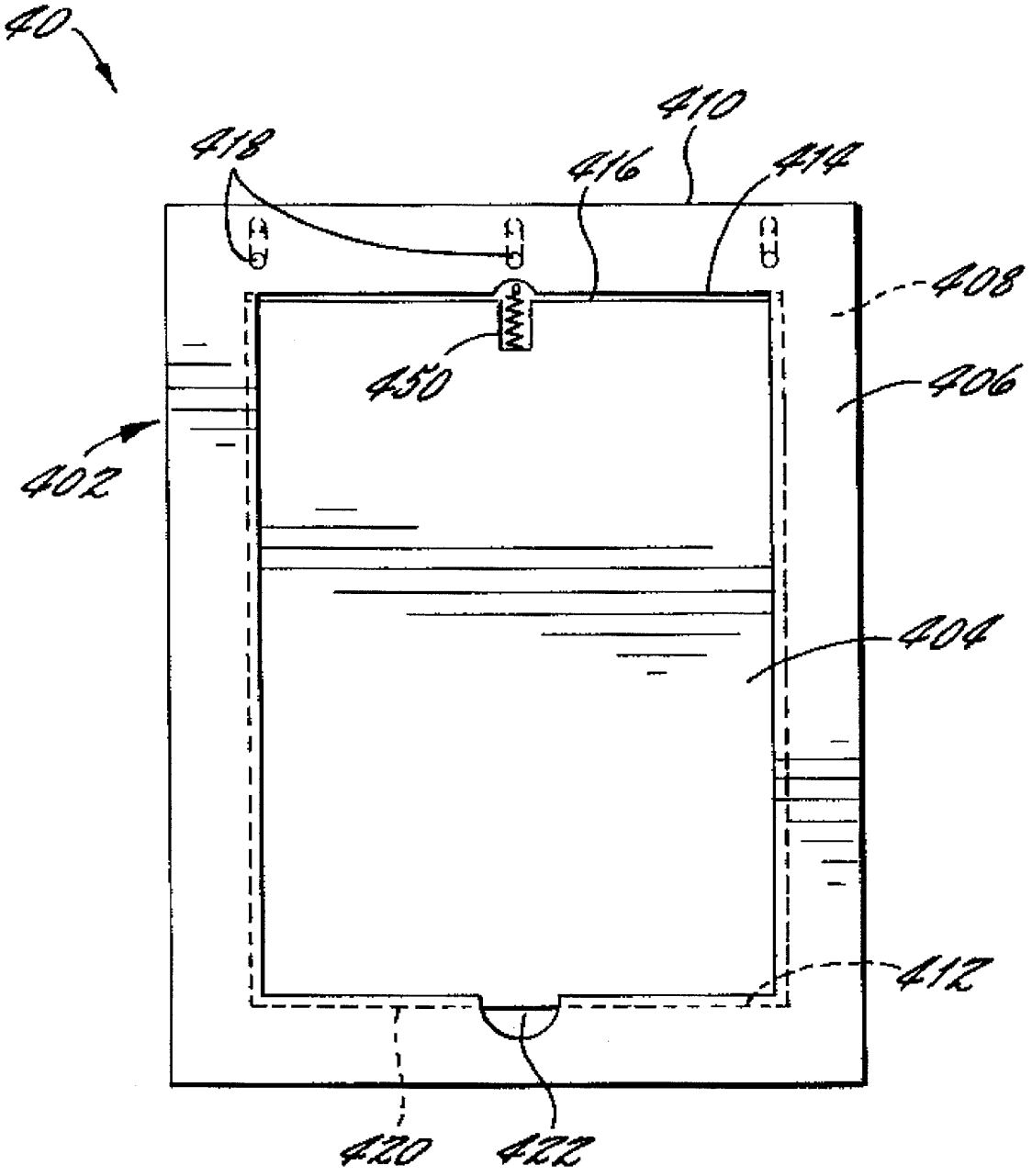
FIG. 6 is a rear view of a combined picture frame and hanger.

Another embodiment of the present invention is the combined picture frame and hanger unit 40 illustrated in FIG. 6. This unit 40 comprises a generally rectangular frame 402 and a removable picture access panel 404. The frame has a generally planar first side 406 for interfacing with wall 60, a second side 408, and a top edge 410. Recess 412 extends around the inner edge 414 of frame 402 between the first 406 and second 408 sides. As in previously described embodiments, a plurality of narrow bores 418 are positioned adjacent top edge 410, extending from the second side 408 to the first side 406 and angling away from top edge 410.

Removable picture access panel 404 restrains a picture within the frame 402. Panel 404 is a flexible sheet that biases a picture between panel 404 and second side 408 of frame 402. Panel 404 is retained within recess 412 by a spring 450 embedded in top edge 416 of panel 404 that biases panel 404 into the lower edge 420 of recess 412. Panel 404 is removed from recess 412 by inserting an object such as a thumb into cutout 422 in the lower edge 420 of recess 412, pushing panel 404 upward, compressing spring 450, and pulling panel 404 out of recess 412.

An additional advantage of picture frame 40 is that the picture access panel 404, representing the maximum size that can be accommodated by the frame, can be used as a template to crop pictures prior to inserting them into the frame.

It may be appreciated by one skilled in the art that a virtually limitless array of embodiments of the wall hanger of the present invention are possible. For instance, a variation of picture hanger 18 could comprise a coat hanger, wherein the hook member would be elongated in order to support a coat. Another potential embodiment is a wall-hung file holder, which would have bore arrangement similar to that in the plate hanger 30. Yet a further embodiment is a mirror hanger, which would comprise a plurality of hangers similar to hanger 15, wherein the molded hook would be replaced by a raised ridge for supporting the mirror frame. Other potential embodiments, which are subsumed under the present wall hanger invention described herein., include hangers for shelves, kitchen racks, telephones, and lamps. It is important to note, however, that each embodiment must be designed with careful attention to the bore positions and angles, since these parameters determine the amount and distribution of weight that can be supported.

Figure 7A:
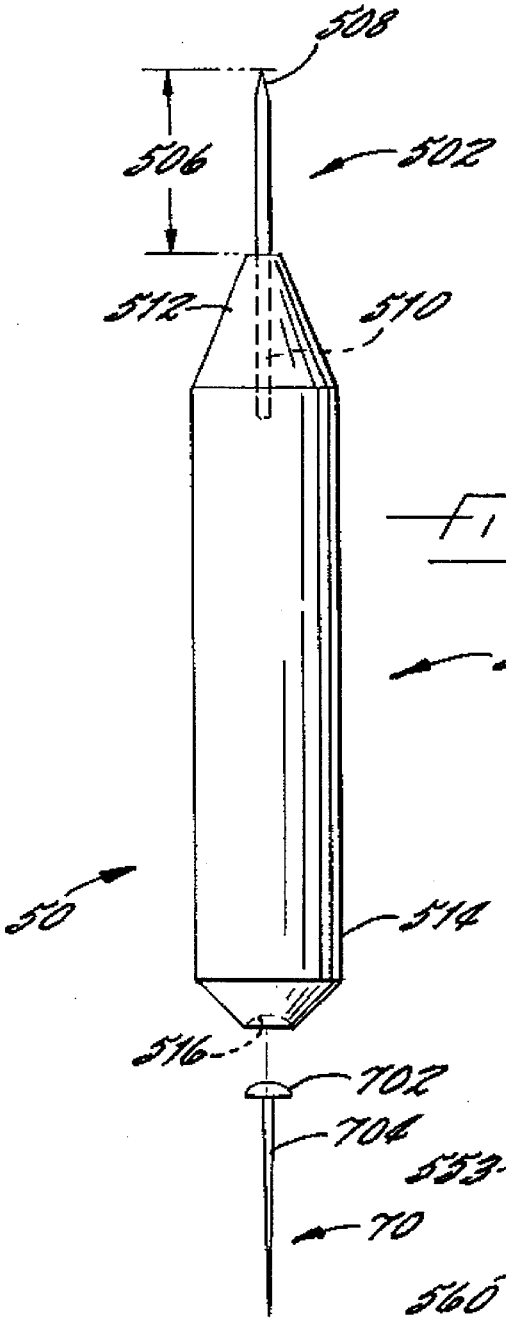
FIG. 7(*a*) illustrates a mounting tool for use with the wall hanger of the present invention.
Figure 7B:
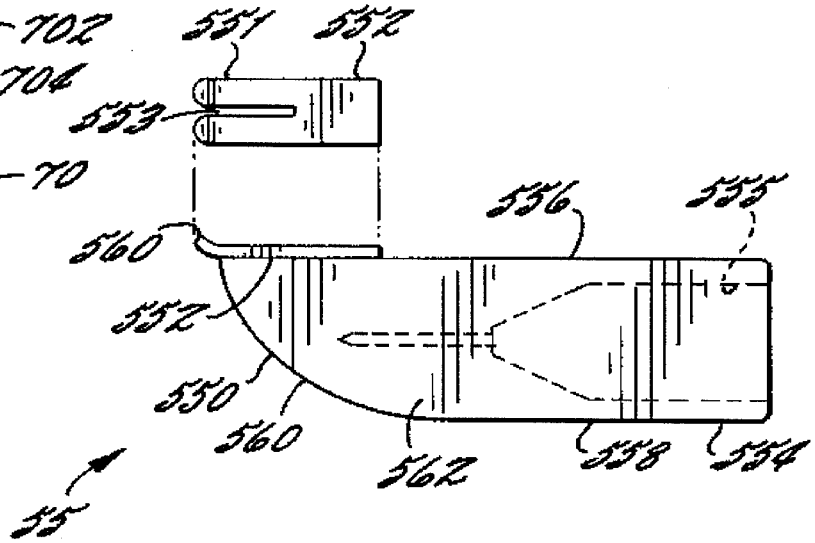
Figure 8A:
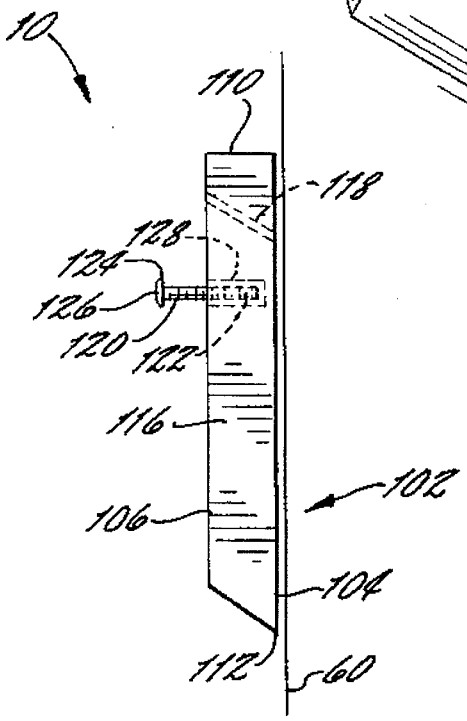
FIG. 8(*a*)–(*d*) illustrates the method of mounting the wall hanger.
Figure 8B:
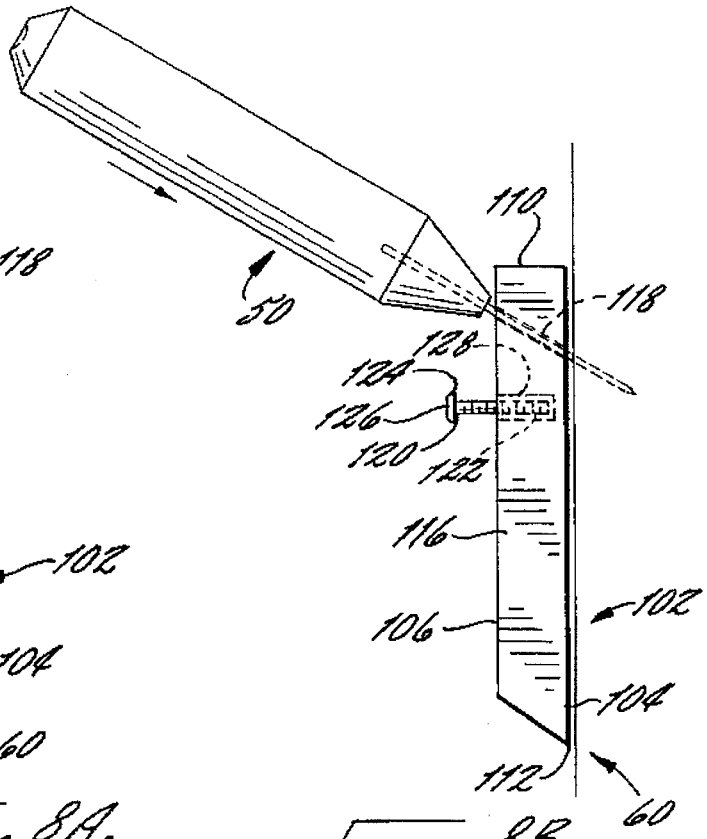
Figure 8C:
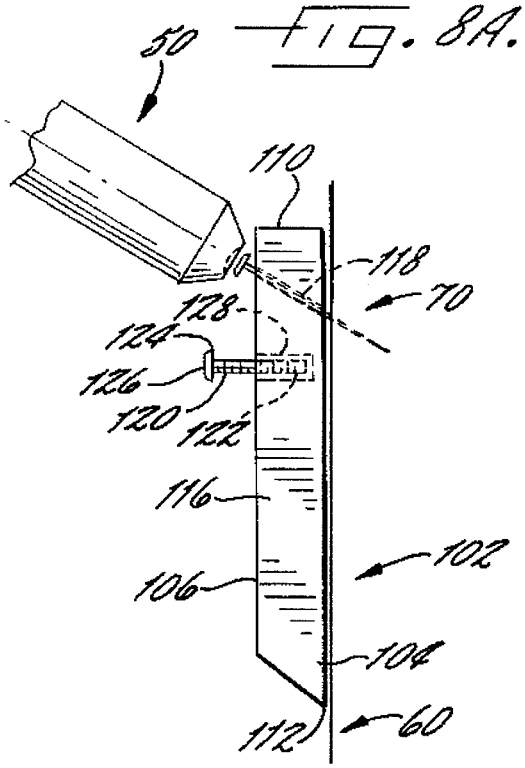
Figure 8D:
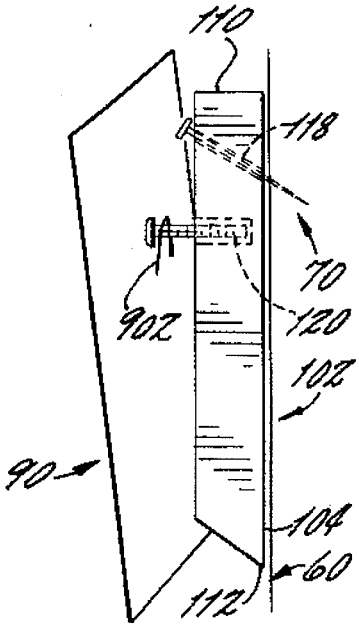

In FIG. 7(*a*) is shown the mounting tool 50 of the present invention that is used in affixing the hangers of the present invention to a wall 60. Mounting tool 50 comprises a pointed borer 502 affixed to a handle 504. Pointed borer 502, having a first pointed end 508 and a second end 510 residing within handle 504, is sufficiently sharp to make holes in a wall 60 after having passed through a bore in the base of a wall hanger. The borer has an exposed length 506 dimensioned to make a hole in a wall 60 sufficiently deep to house a straight pin 70 when straight pin 70 is pushed through the bore and into wall 60.

Handle 504 has a first 512 and a second 514 end. It is in the first end 512 of handle 504 that is affixed to the second end 510 of borer 502. Handle 504 further has an indentation 516 at the second end 514 dimensioned to surround the head 702 of a pin 70 and to push the pin 70 through a bore in the base and into a wall 60.

In FIG. 7(*b*) is shown the removal tool 55 of the present invention that is used to remove a wall hanger of the present invention from a wall. Removal tool 55 comprises a base 562 having a first end 550, the first end 550 having a pin remover 552 affixed thereto. Pin remover 552 comprises a generally rectangular metal element having a channel 553 therein at the first end 551, the channel 553 dimensioned smaller than a head 702 of a pin 70 but larger than the shaft 704 of pin 70. The first end 551 of the base 562 further has an upturned portion 560 to facilitate the insertion of first end 551 underneath the head 702 of pin 70.

The second end 554 of removal tool 55 has a bore 555 therein dimensioned to receive and store the mounting tool 50 discussed above when the mounting tool is not in use. First end 550 has a leading surface that slopes away from the first end 550 and extends from top side 556 to bottom side 558 in order that, when the removal tool 55 is being used, the sloping surface 560 can rock along wall 60 during the prying away of a pin 70 out of the wall 60, as will be shown with reference to FIG. 9.

A wall hanger kit of the present invention comprises a wall hanger and a mounting tool 50 as described above. A second embodiment of the wall hanger kit comprises a wall hanger, a mounting tool 50, and a removal tool 55.

The method of mounting the wall hanger of the present invention, as illustrated in FIG. 8, comprises the steps of providing a wall hanger as described above, here shown as the picture hanger 10 of FIGS. 1 and 2, placing the wall hanger 10 with its first side 102 against a wall 60 and the top edge 110 facing generally upwards; pushing a boring tool 50 through each bore 118 to form a hole in the wall 60 aligned with each bore 118, the hole being sufficiently long to enable a straight pin 70 to pass through the bore 118 and into the wall 60; pushing a straight pin 70 into each bore 118; and mounting the hanger 902 of an object 90 upon the screw 120.

Figure 9A:
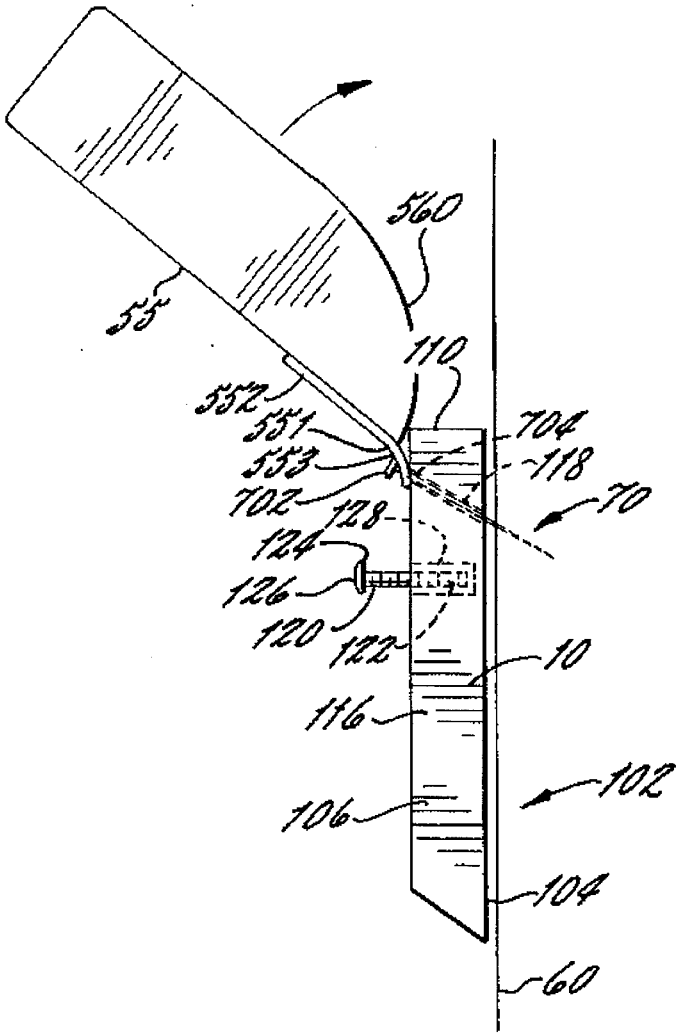
FIG. 9(*a*),(*b*) illustrates the method of removing the wall hanger from the wall.
Figure 9B:
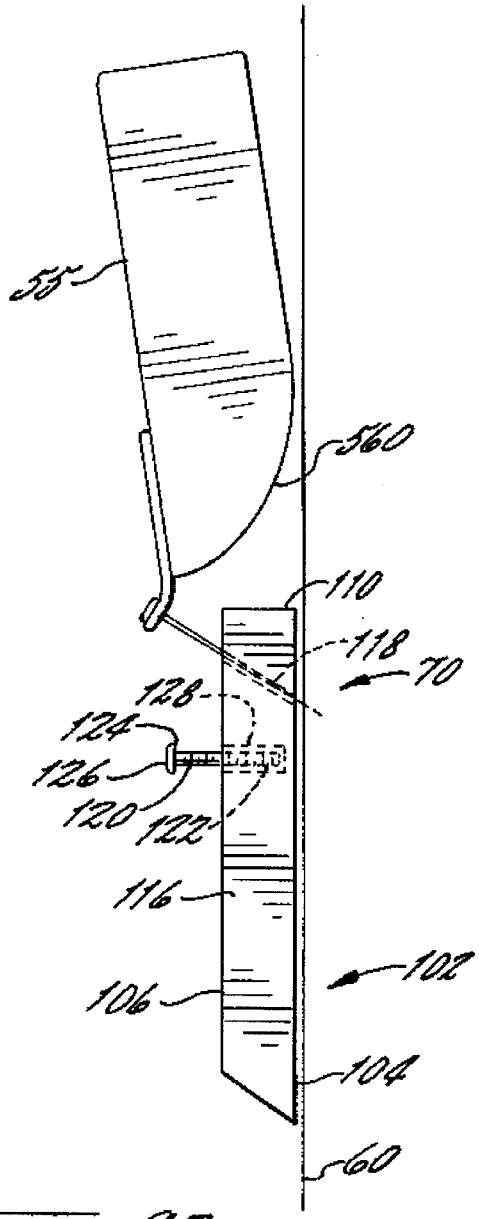

The method of removing the wall hanger of the present invention, as illustrated in FIG. 9, comprises the steps of providing a wall hanger as described above, here shown as the picture hanger 10 of FIGS. 1 and 2, having its first side 102 mounted against a wall 60 with its top edge 110 facing generally upwards, the mounting having been accomplished with the use of straight pins 70 penetrating bores 118 and the wall; inserting the first end 551 of the pin remover 552 of the removal tool 55 beneath the head 702 of a pin 70 so that channel 553 surrounds shaft 704 of pin 70 [FIG. 9(*a*)]; and prying the pin 70 out of wall 60 by rocking the removal tool 55 along sloping portion 560 [FIG. 9(*b*)].

One subset of the embodiments of the wall hangers of the present invention may be removed without the use of a removal tool. Specifically, those embodiments wherein the narrow bores are all disposed parallel to each other may be removed simply by grasping the support means and lifting the wall hanger away from the wall.

It may be appreciated by one skilled in the art that additional embodiments may be contemplated, including hangers for shelves, kitchen racks, coat racks, telephones, and lamps.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A wall hanger for minimizing damage to a wall comprising:

a base having:

a generally planar first side for interfacing with a wall;

a second side opposed to the first side;

a top and a bottom edge;

a plurality of narrow bores extending from the second side to the first side, positioned generally along the top edge of the base, and angling away from the top edge, wherein each bore is sufficiently narrow and sufficiently long to permit a straight pin to pass therethrough and penetrate a wall when the first side is placed against the wall;

a support member for supporting an object, the support member having a first end affixed to and protruding from the second side of the base and positioned generally along the bottom edge thereof, the support member further having a second end having means for cradling an object; and an adjustable-thickness spacer affixed to the second side of the base between the bottom edge and the top edge for biasing the object at variable distances from the base;

wherein the bores are situated sufficiently close to the top edge that a portion of the base between the bores and the bottom edge is sufficient to provide resistance against a moment caused by suspending an object from the support means.

2. The wall hanger recited in claim 1, wherein the spacer comprises:

a first spacer having a first side and a second side, the first side affixed to second side of the base, the second side comprising a first half of a pair of materials that adhere when pressed together; and a second spacer having a first side and a second side, the first side having a second half of a pair of materials that adhere when pressed together.

3. The wall hanger recited in claim 2, wherein the second side of the second spacer comprises a protective material that will protect an object from being scratched.

4. The wall hanger recited in claim 2, further comprising a third spacer having:

a first side having a second half of a pair of materials that adhere when pressed together; and a second side having a first half of a pair of materials that adhere when pressed together; wherein the first side of the third spacer is affixed to the second side of the first spacer and the second side of the third spacer is affixed to the first side of the second spacer.

5. A plate hanger for minimizing damage to a wall comprising:

a clear plastic base having:

a generally planar first side for interfacing with a wall;

a generally planar second side opposed to the first side;

a top and a bottom edge;

a pair of generally opposed side edges; and a plurality of narrow bores positioned along the top edge extending in a direction away from the top edge from the second side to the first side, wherein each bore is sufficiently narrow and sufficiently long to permit a straight pin to pass therethrough and penetrate a wall when the first side is placed against the wall;

a pair of support arms positioned in spaced relation generally along the bottom edge of the base, each support arm having a first end affixed to the second side of the base and a second end having means for cradling a plate;

a first spacing means affixed to the second side of the base beneath the narrow bores for biasing the plate a first distance away from the base, the first spacing means comprising:

a first spacer having a first side and a second side, the first side affixed to second side of the base, the second side comprising a first half of a pair of materials that adhere when pressed together; and a second spacer having a first side and a second side, the first side comprising a second half of a pair of materials that adhere when pressed together; and a second spacing means affixed to the second side of the base between the first spacing means and the support arms for biasing the plate a second distance away from the base, the second distance greater than the first distance, the second spacing means comprising:

a third spacer having a first side and a second side, the first side affixed to second side of the base, the second side comprising a first half of a pair of materials that adhere when pressed together;

a fourth spacer having a first side and a second side, the first side comprising a second half of a pair of materials that adhere when pressed together; and a fifth spacer having a first side comprising a second half of a pair of materials that adhere when pressed together and a second side comprising a first half of a pair of materials that adhere when pressed together;

wherein the first side of the fifth spacer is affixed to the second side of the third spacer and the second side of the fifth spacer is affixed to the first side of the fourth spacer.

6. The plate hanger recited in claim 5, wherein the support arms each comprises a unitary clear plastic member wherein:

the first end comprises a V-shaped member having a side wing positioned adjacent a side edge of the base, a wing junction positioned adjacent the junction of the side edge and the bottom edge of the base, and a bottom wing forming an acute angle with the bottom edge of the base;

the side and the bottom wings of the first end taper inward toward the second end; and the second end comprises a narrowed portion rolled into an upwardly curling brace against which the bottom of a plate is suportable.

7. The plate hanger recited in claim 5, wherein the second side of the second spacer and the second side of the fourth spacer each further comprise a protective material for protecting the surface of a plate when the plate rests thereagainst.

* * * * *